US006959626B1

(12) United States Patent
Shen

(10) Patent No.: US 6,959,626 B1
(45) Date of Patent: Nov. 1, 2005

(54) RATCHET WRENCH HAVING EXACT LIMIT EFFECT

(75) Inventor: Rui-Chi Shen, Taichung Hsien (TW)

(73) Assignee: Stanley Chiro International, Ltd., Taichung Hsien (TW)

( * ) Notice: Subject to any disclaimer, the term of this patent is extended or adjusted under 35 U.S.C. 154(b) by 27 days.

(21) Appl. No.: 10/828,314

(22) Filed: Apr. 21, 2004

(51) Int. Cl.[7] ..... B25B 13/46
(52) U.S. Cl. ..... 81/63.2; 81/63
(58) Field of Search ..... 81/60–63.2

(56) References Cited

U.S. PATENT DOCUMENTS 4,561,329 A * 12/1985 Lack ..... 81/62
4,562,757 A * 1/1986 Furey ..... 81/63
6,513,409 B1 * 2/2003 Lee ..... 81/63
2005/0011314 A1 * 1/2005 Chen ..... 81/63

* cited by examiner

*Primary Examiner*—David B. Thomas
(74) *Attorney, Agent, or Firm*—Bacon & Thomas PLLC

(57) ABSTRACT

A ratchet wrench includes a handle, a drive head, a ratchet wheel, a control knob, and a substantially C-shaped limit spring. Thus, the control knob is rigidly and stably positioned in the receiving chamber of the drive head by the limit spring, thereby facilitating a user operating the control knob. In addition, the ratchet wrench only needs to provide a limit spring to position the control knob rigidly and stably, so that the ratchet wrench has a simplified construction, thereby decreasing costs of fabrication.

17 Claims, 5 Drawing Sheets

RATCHET WRENCH HAVING EXACT LIMIT EFFECT

BACKGROUND OF THE INVENTION

1. Field of the Invention

The present invention relates to a ratchet wrench, and more particularly to a ratchet wrench having an exact limit effect.

2. Description of the Related Art

In general, a conventional ratchet wrench comprises a handle, a drive head mounted on a distal end of the handle and having a first end formed with a receiving hole, a mediate portion formed with a receiving recess communicating with the receiving hole, and a second end formed with a receiving chamber communicating with the receiving recess, a ratchet wheel mounted in the receiving hole of the drive head, a pawl member pivotally mounted in the receiving recess of the drive head and engaged with the ratchet wheel, and a control knob rotatably mounted in the receiving chamber of the drive head and rested on the pawl member to push the pawl member to press the ratchet wheel to control the drive direction of the ratchet wheel. Thus, by control of the control knob, the ratchet wheel is rotated in one direction only when the drive head is rotated.

However, the control knob is not easily positioned in the receiving chamber of the drive head rigidly and stably, thereby causing inconvenience to a user when operating the control knob. In addition, the conventional ratchet wrench has a complicated construction, thereby greatly increasing the costs of fabrication.

SUMMARY OF THE INVENTION

The present invention is to mitigate and/or obviate the disadvantage of the conventional ratchet wrench.

The primary objective of the present invention is to provide a ratchet wrench having an exact limit effect.

Another objective of the present invention is to provide a ratchet wrench that only needs to provide a limit spring to position the control knob rigidly and stably, so that the ratchet wrench has a simplified construction, thereby decreasing costs of fabrication.

A further objective of the present invention is to provide a ratchet wrench, wherein the urging spring is supported and guided by the guide shaft of the positioning plate, so that the positioning plate is not easily deformed, thereby facilitating movement of the urging spring.

A further objective of the present invention is to provide a ratchet wrench, wherein the positioning plate is urged on the positioning edge of the pawl member rigidly and stably so as to position the pawl member exactly.

A further objective of the present invention is to provide a ratchet wrench, wherein the control knob is rigidly and stably positioned in the receiving chamber of the drive head by the limit spring, thereby facilitating a user operating the control knob.

In accordance with the present invention, there is provided a ratchet wrench, comprising:

a handle;

a drive head mounted on an end of the handle and having a first end formed with a receiving hole, a mediate portion formed with a receiving recess communicating with the receiving hole, and a second end formed with a receiving chamber communicating with the receiving recess;

a ratchet wheel mounted in the receiving hole of the drive head;

a pawl member pivotally mounted in the receiving recess of the drive head and engaged with the ratchet wheel;

a control knob rotatably mounted in the receiving chamber of the drive head and rested on the pawl member to push the pawl member to press the ratchet wheel, the control knob having an inside formed with a passage radially extended through the control knob; and a substantially C-shaped limit spring mounted on the control knob to rotate with the control knob and having a mediate portion formed with a insertion portion inserted into the passage of the control knob and two distal ends each formed with an protruding locking portion that is movable to press the drive head to position the limit spring and the control knob on the drive head.

Further benefits and advantages of the present invention will become apparent after a careful reading of the detailed description with appropriate reference to the accompanying drawings.

DETAILED DESCRIPTION OF THE INVENTION

Figure 1:
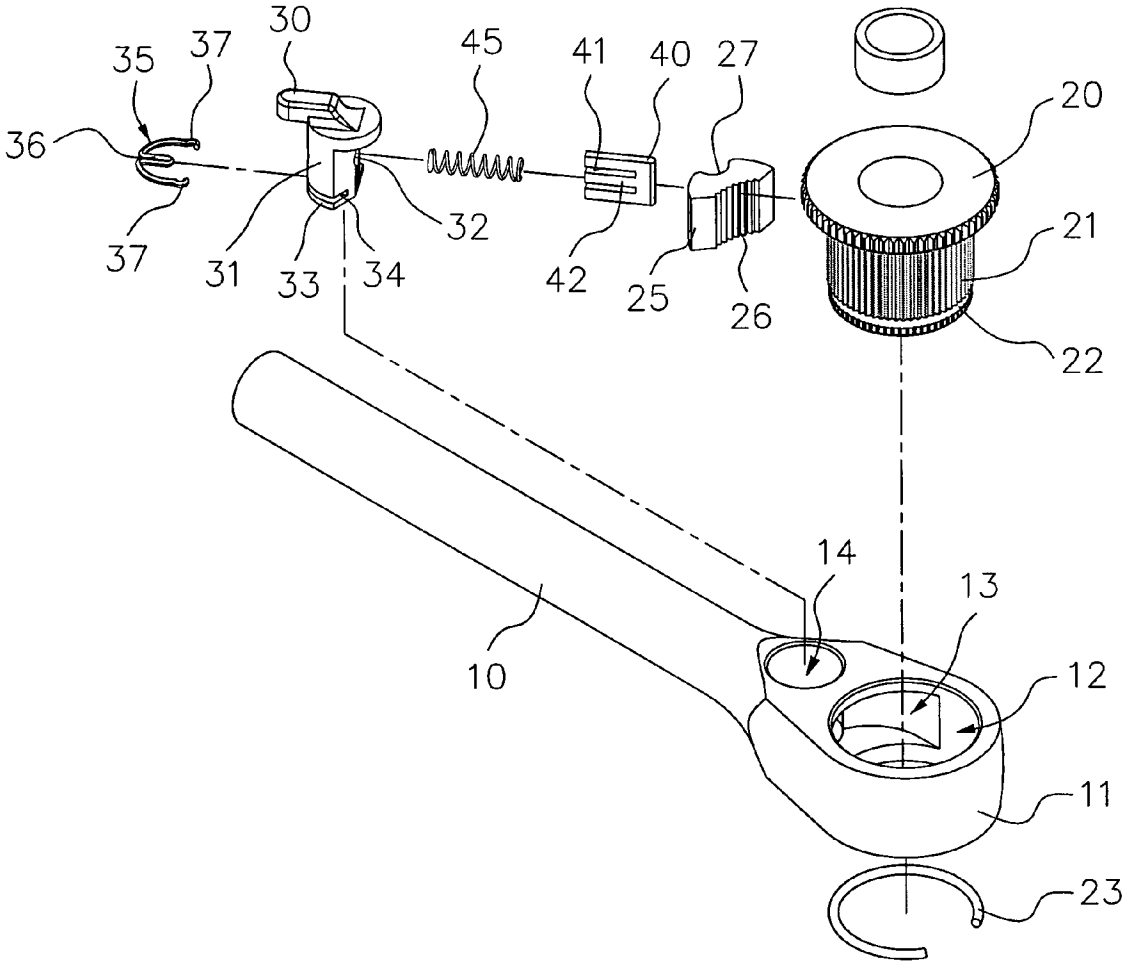
FIG. 1 is an exploded perspective view of a ratchet wrench in accordance with the preferred embodiment of the present invention.
Figure 2:
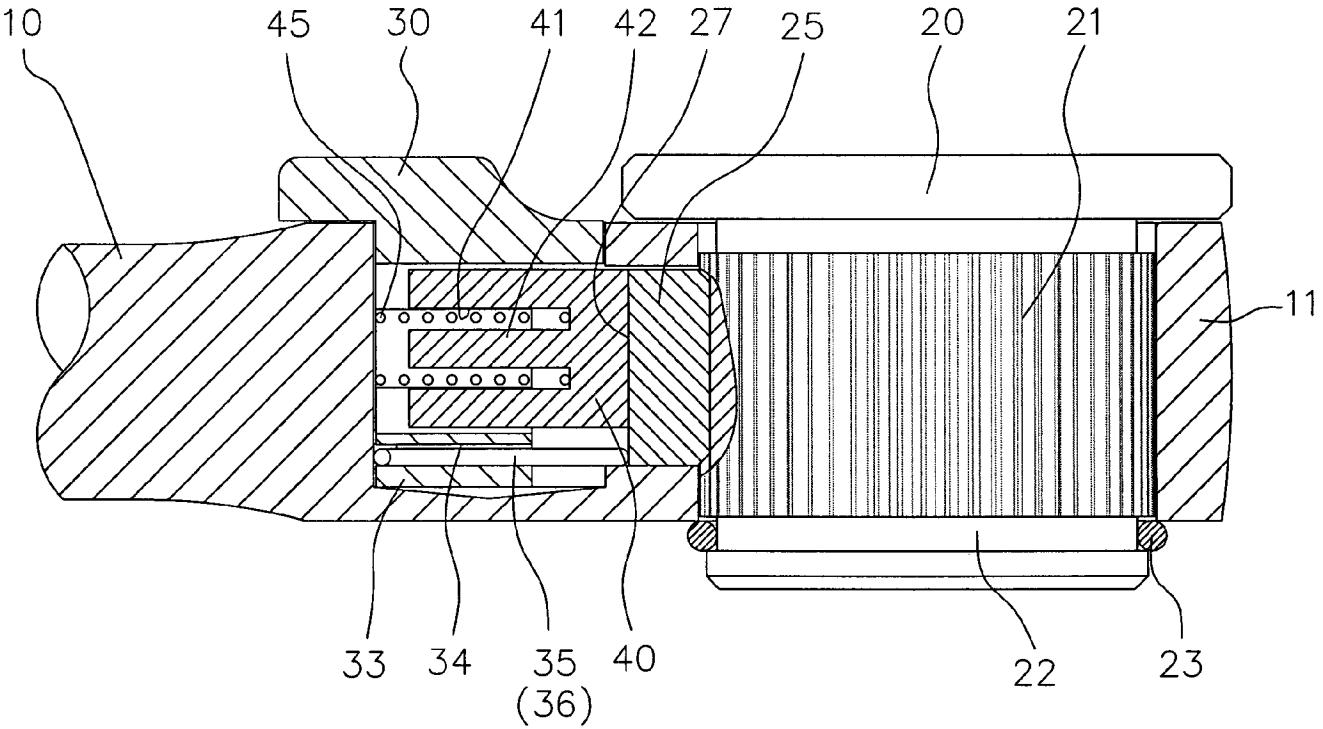
FIG. 2 is a partially cut-away plan cross-sectional assembly view of the ratchet wrench as shown in FIG. 1.
Figure 3:
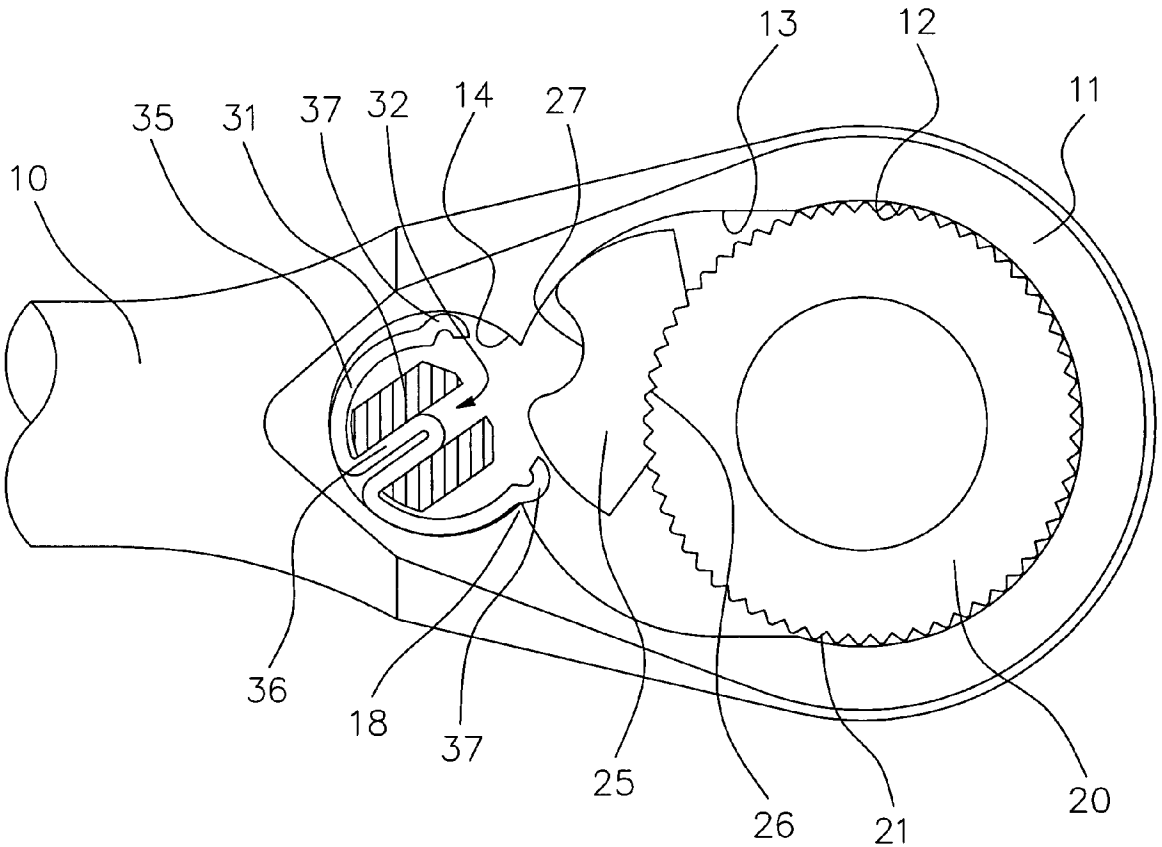
FIG. 3 is a partially cut-away top plan cross-sectional assembly view of the ratchet wrench as shown in FIG. 1.

Referring to the drawings and initially to FIGS. 1–3, a ratchet wrench in accordance with the preferred embodiment of the present invention comprises a handle 10, a drive head 11 mounted on an end of the handle 10 and having a first end formed with a receiving hole 12, a mediate portion formed with a receiving recess 13 communicating with the receiving hole 12, and a second end formed with a receiving chamber 14 communicating with the receiving recess 13, a ratchet wheel 20 mounted in the receiving hole 12 of the drive head 11, a pawl member 25 pivotally mounted in the receiving recess 13 of the drive head 11 and engaged with the ratchet wheel 20, and a control knob 31 rotatably mounted in the receiving chamber 14 of the drive head 11 and rested on the pawl member 25 to push the pawl member 25 to press the ratchet wheel 20 to control the drive direction of the ratchet wheel 20. The above-mentioned structure and manner of operation are conventional and will not be further described in detail.

The ratchet wheel 20 is a substantially T-shaped socket. The ratchet wheel 20 has a periphery formed with a plurality of ratchet teeth 21 and has a bottom formed with an annular groove 22 for fixing a C-shaped snap ring 23 which is rested on a bottom of the drive head 11 to secure the ratchet wheel 20 on the drive head 11.

The pawl member 25 has a first side formed with a plurality of engaging teeth 26 engaged with the ratchet teeth 21 of the ratchet wheel 20 and a second side formed with an arcuate positioning edge 27.

The control knob 31 has an inside formed with a passage 32 radially extended through the control knob 31 and aligned with the positioning edge 27 of the pawl member 25 and has a periphery formed with an annular snap groove 34. Preferably, the snap groove 34 of the control knob 31 is located under and communicated with the passage 32. The control knob 31 has a first end formed with a drive handle 30 protruding outward from the drive head 11 and a second end formed with an enlarged resting plate 33 located adjacent to the snap groove 34 and rested on the limit spring 35.

A substantially C-shaped limit spring 35 is mounted in the snap groove 34 of the control knob 31 to rotate with the control knob 31 and has a mediate portion formed with a substantially U-shaped insertion portion 36 inserted into the passage 32 of the control knob 31 and two distal ends each formed with an arc-shaped protruding locking portion 37. The locking portion 37 of the limit spring 35 is bent outward and is movable with the limit spring 35 to abut a connection 18 of the receiving recess 13 and the receiving chamber 14 of the drive head 11 as shown in FIG. 3 to enhance the positioning effect of the limit spring 35 on the control knob 31.

A substantially E-shaped positioning plate 40 is mounted in the passage 32 of the control knob 31 and has a first end rested on the positioning edge 27 of the pawl member 25, and an urging spring 45 is mounted in a second end of the positioning plate 40 and urged between the positioning plate 40 and the drive head 11, so that the positioning plate 40 is urged on the positioning edge 27 of the pawl member 25 rigidly and stably as shown in FIG. 2 so as to position the pawl member 25 exactly. The second end of the positioning plate 40 is formed with two slits 41 and a guide shaft 42 located between the two slits 41, and the urging spring 45 is mounted on the guide shaft 42 and located between the two slits 41. Thus, the urging spring 45 is supported and guided by the guide shaft 42 of the positioning plate 40, so that the positioning plate 40 is not easily deformed, thereby facilitating movement of the urging spring 45. In addition, the positioning plate 40 has a bottom rested on the insertion portion 36 of the limit spring 35.

In operation, referring to FIGS. 2 and 3 with reference to FIG. 1, the control knob 31 is rotated by the drive handle 30, so that the positioning plate 40 mounted on the control knob 31 is moved by rotation of the control knob 31 to push the pawl member 25 to move into an included angle defined by the ratchet wheel 20 and the inner edge of the drive head 11 to lock the ratchet wheel 20 on the drive head 11 so as to control the drive direction of the ratchet wheel 20. Thus, the ratchet wheel 20 is rotated in one direction only when the drive head 11 is rotated.

At the same time, when the control knob 31 is rotated, the limit spring 35 is also rotated. Thus, the locking portion 37 of one of the two distal ends of the limit spring 35 is moved to abut the connection 18 of the receiving recess 13 and the receiving chamber 14 of the drive head 11, and the locking portion 37 of the other one of the two distal ends of the limit spring 35 is moved to press an inner edge of the receiving chamber 14 of the drive head 11 as shown in FIG. 3 to produce a locking effect on the control knob 31, so that the control knob 31 is rigidly and stably positioned in the receiving chamber 14 of the drive head 11 by the limit spring 35, thereby facilitating a user operating the control knob 31.

Accordingly, the ratchet wrench only needs to provide a limit spring 35 to position the control knob 31 rigidly and stably, so that the ratchet wrench has a simplified construction, thereby decreasing costs of fabrication. In addition, the urging spring 45 is supported and guided by the guide shaft 42 of the positioning plate 40, so that the positioning plate 40 is not easily deformed, thereby facilitating movement of the urging spring 45. Further, the positioning plate 40 is urged on the positioning edge 27 of the pawl member 25 rigidly and stably so as to position the pawl member 25 exactly. Further, the control knob 31 is rigidly and stably positioned in the receiving chamber 14 of the drive head 11 by the limit spring 35, thereby facilitating a user operating the control knob 31.

Figure 4:
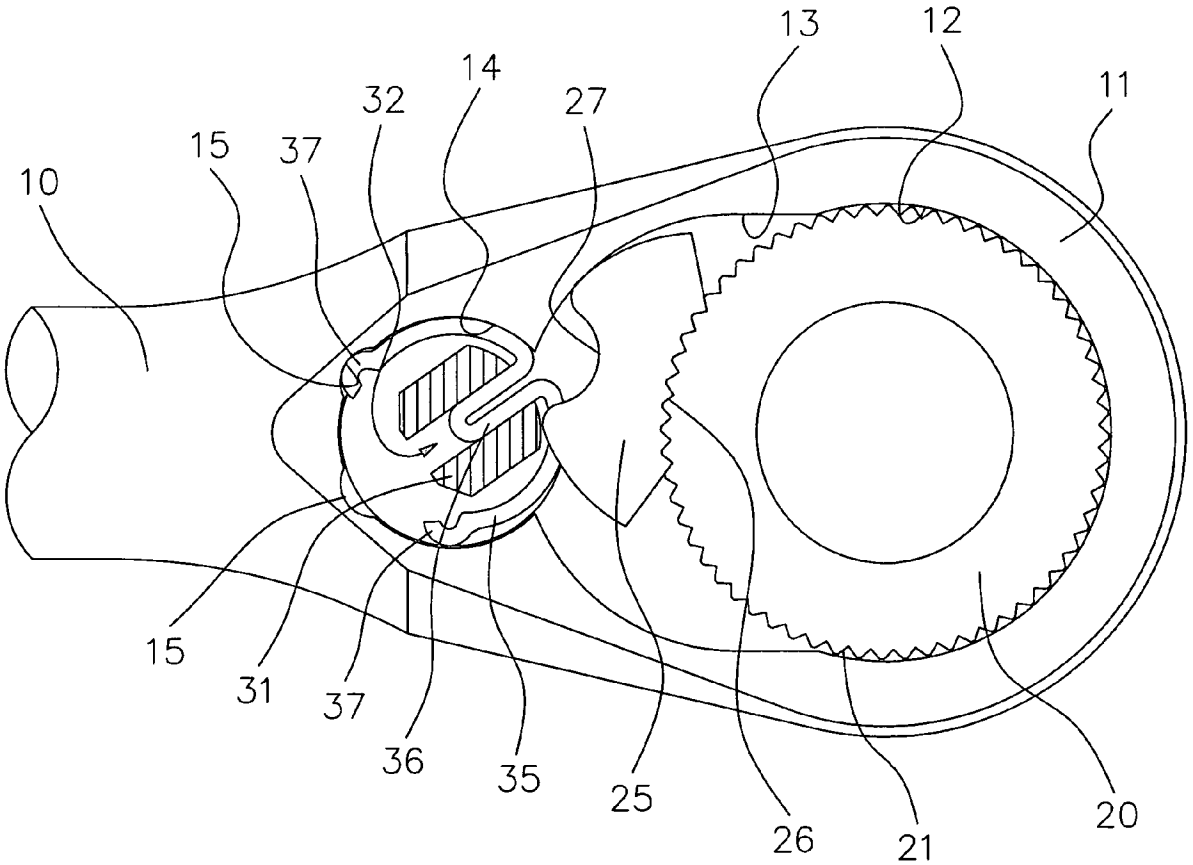
FIG. 4 is a partially cut-away top plan cross-sectional assembly view of a ratchet wrench in accordance with another embodiment of the present invention.

Referring to FIG. 4, in accordance with another embodiment of the present invention, the receiving chamber 14 of the drive head 11 has a wall formed with two spaced arch-shaped locking recesses 15 located adjacent to the handle 10. The control knob 31 has an inner side facing the pawl member 25, and the limit spring 35 is mounted on the inner side of the control knob 31, wherein the locking portion 37 of one of the two distal ends of the limit spring 35 is inserted into and locked in a respective one of the two locking recesses 15 of the drive head 11, so that the control knob 31 is rigidly and stably positioned in the receiving chamber 14 of the drive head 11 by the limit spring 35, thereby facilitating a user operating the control knob 31.

Figure 5:
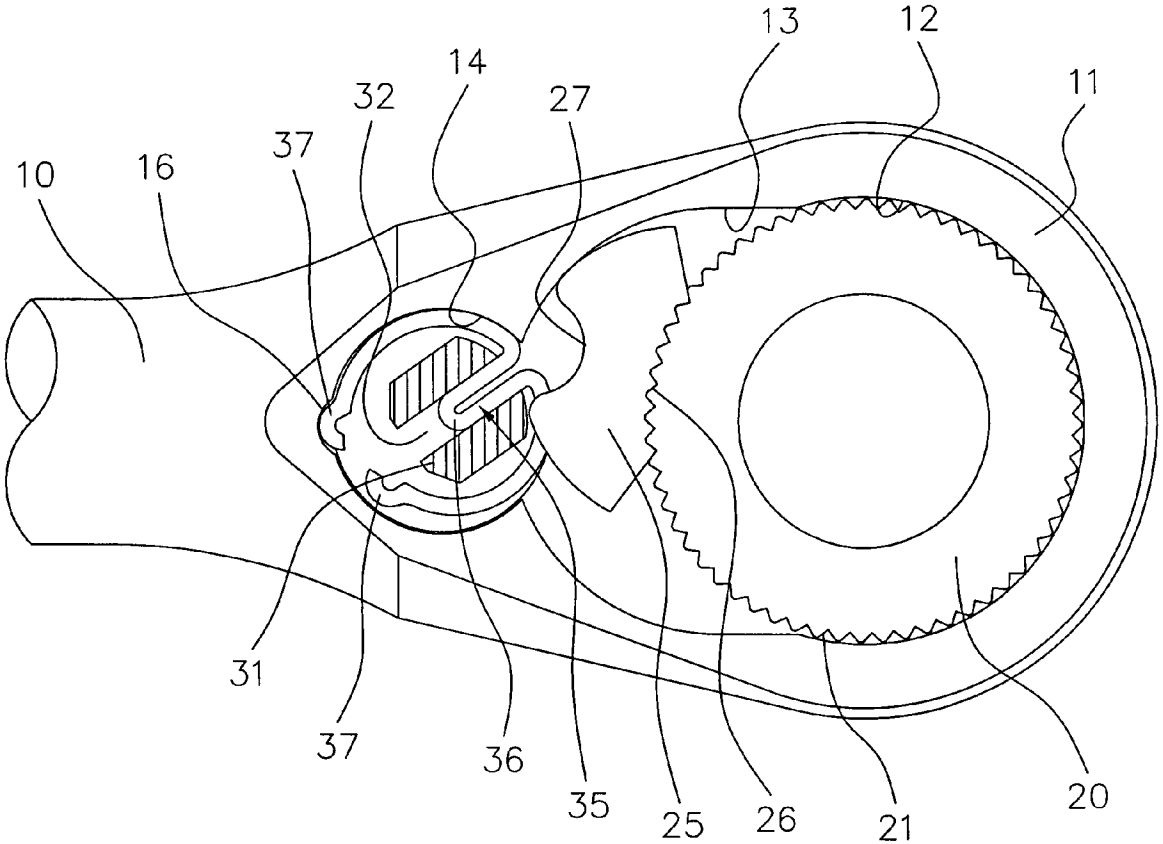
FIG. 5 is a partially cut-away top plan cross-sectional assembly view of a ratchet wrench in accordance with another embodiment of the present invention.

Referring to FIG. 5, in accordance with another embodiment of the present invention, the receiving chamber 14 of the drive head 11 has a wall formed with an arch-shaped locking recess 16 located adjacent to the handle 10. The control knob 31 has an inner side facing the pawl member 25, and the limit spring 35 is mounted on the inner side of the control knob 31, wherein the locking portion 37 of either one of the two distal ends of the limit spring 35 is inserted into and locked in the locking recess 15 of the drive head 11, so that the control knob 31 is rigidly and stably positioned in the receiving chamber 14 of the drive head 11 by the limit spring 35, thereby facilitating a user operating the control knob 31.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A ratchet wrench, comprising:

a handle;

a drive head mounted on an end of the handle and having a first end formed with a receiving hole, a mediate portion formed with a receiving recess communicating with the receiving hole, and a second end formed with a receiving chamber communicating with the receiving recess;

a ratchet wheel mounted in the receiving hole of the drive head;

a pawl member pivotally mounted in the receiving recess of the drive head and engaged with the ratchet wheel;

a control knob rotatably mounted in the receiving chamber of the drive head and rested on the pawl member to push the pawl member to press the ratchet wheel, the control knob having an inside formed with a passage radially extended through the control knob; and a substantially C-shaped limit spring mounted on the control knob to rotate with the control knob and having a mediate portion formed with a insertion portion inserted into the passage of the control knob and two distal ends each formed with an protruding locking portion that is movable to press the drive head to position the limit spring and the control knob on the drive head.

2. The ratchet wrench in accordance with claim 1, wherein the locking portion of one of the two distal ends of the limit spring is moved to abut a connection of the receiving recess and the receiving chamber of the drive head, and the locking portion of the other one of the two distal ends of the limit spring is moved to press an inner edge of the receiving chamber of the drive head to produce a locking effect on the control knob, so that the control knob positioned in the receiving chamber of the drive head by the limit spring.

3. The ratchet wrench in accordance with claim 1, wherein the locking portion of the limit spring is arc-shaped.

4. The ratchet wrench in accordance with claim 1, wherein the locking portion of the limit spring is bent outward.

5. The ratchet wrench in accordance with claim 1, wherein the control knob has a periphery formed with an annular snap groove, and the limit spring is mounted in the snap groove of the control knob.

6. The ratchet wrench in accordance with claim 5, wherein the snap groove of the control knob is located under and communicated with the passage.

7. The ratchet wrench in accordance with claim 5, wherein the control knob has a first end formed with a drive handle protruding outward from the drive head and a second end formed with an enlarged resting plate located adjacent to the snap groove and rested on the limit spring.

8. The ratchet wrench in accordance with claim 1, wherein the insertion portion of the limit spring is substantially U-shaped.

9. The ratchet wrench in accordance with claim 1, further comprising a positioning plate mounted in the passage of the control knob and having a first end rested on the pawl member, and an urging spring mounted in a second end of the positioning plate and urged between the positioning plate and the drive head, so that the positioning plate is urged on the pawl member.

10. The ratchet wrench in accordance with claim 9, wherein the positioning plate is substantially E-shaped.

11. The ratchet wrench in accordance with claim 9, wherein the second end of the positioning plate is formed with two slits and a guide shaft located between the two slits, and the urging spring is mounted on the guide shaft and located between the two slits.

12. The ratchet wrench in accordance with claim 1, wherein the positioning plate has a bottom rested on the insertion portion of the limit spring.

13. The ratchet wrench in accordance with claim 1, wherein the ratchet wheel is a substantially T-shaped socket.

14. The ratchet wrench in accordance with claim 1, wherein the ratchet wheel has a bottom formed with an annular groove for fixing a C-shaped snap ring which is rested on a bottom of the drive head to secure the ratchet wheel on the drive head.

15. The ratchet wrench in accordance with claim 1, wherein the ratchet wheel has a periphery formed with a plurality of ratchet teeth, the pawl member has a first side formed with a plurality of engaging teeth engaged with the ratchet teeth of the ratchet wheel and a second side formed with an arcuate positioning edge, and the passage of the control knob is aligned with the positioning edge of the pawl member.

16. The ratchet wrench in accordance with claim 1, wherein the receiving chamber of the drive head has a wall formed with two spaced arch-shaped locking recesses located adjacent to the handle, the control knob has an inner side facing the pawl member, the limit spring is mounted on the inner side of the control knob, and the locking portion of one of the two distal ends of the limit spring is inserted into and locked in a respective one of the two locking recesses of the drive head.

17. The ratchet wrench in accordance with claim 1, wherein the receiving chamber of the drive head has a wall formed with an arch-shaped locking recess located adjacent to the handle, the control knob has an inner side facing the pawl member, the limit spring is mounted on the inner side of the control knob, and the locking portion of either one of the two distal ends of the limit spring is inserted into and locked in the locking recess of the drive head.

* * * * *